US007615926B2

(12) United States Patent
Eden et al.

(10) Patent No.: US 7,615,926 B2
(45) Date of Patent: Nov. 10, 2009

(54) LOW VOLTAGE MICROCAVITY PLASMA DEVICE AND ADDRESSABLE ARRAYS

(75) Inventors: J. Gary Eden, Mahomet, IL (US); Sung-Jin Park, Champaign, IL (US); Paul A. Tchertchian, Urbana, IL (US); Seung Hoon Sung, Urbana, IL (US)

(73) Assignee: The Board of Trustees of the University of Illinois, Urbana, IL (US)

( * ) Notice: Subject to any disclaimer, the term of this patent is extended or adjusted under 35 U.S.C. 154(b) by 0 days.

(21) Appl. No.: 11/811,892

(22) Filed: Jun. 12, 2007

(65) Prior Publication Data

US 2008/0129185 A1 Jun. 5, 2008

Related U.S. Application Data

(60) Provisional application No. 60/812,755, filed on Jun. 12, 2006.

(51) Int. Cl.
*H01J 17/49* (2006.01)

(52) U.S. Cl. ..... 313/582

(58) Field of Classification Search ..... 313/582–587, 313/490–494; 250/288
See application file for complete search history.

(56) References Cited

U.S. PATENT DOCUMENTS

| | | | |
|---|---|---|---|
| 6,016,027 | A | 1/2000 | DeTemple et al. |
| 6,097,145 | A | 8/2000 | Kastalsky et al. |
| 6,139,384 | A | 10/2000 | DeTemple et al. |
| 6,147,349 | A | 11/2000 | Ray |
| 6,194,833 | B1 | 2/2001 | DeTemple et al. |
| 6,346,770 | B1 | 2/2002 | Schoenbach et al. |
| 6,433,480 | B1 | 8/2002 | Stark et al. |
| 6,538,367 | B1 | 3/2003 | Choi et al. |
| 6,541,915 | B2 | 4/2003 | Eden et al. |
| 6,563,257 | B2 | 5/2003 | Vojak et al. |

(Continued)

FOREIGN PATENT DOCUMENTS

| | | |
|---|---|---|
| KR | 2003-0045540 | 6/2003 |

OTHER PUBLICATIONS

S.J Park & J.G. Eden, "Stable microplasma in air generated with a silicon inverted pyrami plasma cathode," Apr. 2005, IEEE Transactions on plasma science, vol. 33, No. 2, p. 570-571.*

(Continued)

*Primary Examiner*—Toan Ton
*Assistant Examiner*—Hana A Sanei
(74) *Attorney, Agent, or Firm*—Greer, Burns & Crain, Ltd.

(57) ABSTRACT

Microcavity plasma devices and arrays of microcavity plasma devices are provided that have a reduced excitation voltage. A trigger electrode disposed proximate to a microcavity reduce the excitation voltage required between first and second electrodes to ignite a plasma in the microcavity when gas(es) or vapor(s) (or combinations thereof) are contained within the microcavity. The invention also provides symmetrical microplasma devices and arrays of microcavity plasma devices for which current waveforms are the same for each half-cycle of the voltage driving waveform. Additionally, the invention also provides devices that have standoff portions and voids that can reduce cross talk. The devices are preferably also used with a trigger electrode.

38 Claims, 16 Drawing Sheets

U.S. PATENT DOCUMENTS

| | | | | |
|---|---|---|---|---|
| 6,580,217 | B2 | 6/2003 | Kim et al. | |
| 6,597,120 | B1 | 7/2003 | Schemerhorn et al. | |
| 6,612,889 | B1 | 9/2003 | Green et al. | |
| 6,657,370 | B1 | 12/2003 | Geusic | |
| 6,695,664 | B2 | 2/2004 | Eden et al. | |
| 6,815,891 | B2 | 11/2004 | Eden et al. | |
| 6,828,730 | B2 | 12/2004 | Eden et al. | |
| 6,867,548 | B2 | 3/2005 | Eden et al. | |
| 7,112,918 | B2 | 9/2006 | Eden et al. | |
| 7,126,266 | B2 | 10/2006 | Park et al. | |
| 2002/0113553 | A1 | 8/2002 | Vojak et al. | |
| 2003/0080664 | A1* | 5/2003 | Eden et al. | 313/356 |
| 2003/0080688 | A1* | 5/2003 | Eden et al. | 315/169.3 |
| 2003/0132693 | A1 | 7/2003 | Eden et al. | |
| 2003/0230983 | A1 | 12/2003 | Vonallmen | |
| 2004/0100194 | A1 | 5/2004 | Eden et al. | |
| 2004/0144733 | A1 | 7/2004 | Cooper et al. | |
| 2005/0148270 | A1 | 7/2005 | Eden et al. | |
| 2005/0269953 | A1 | 12/2005 | Eden et al. | |
| 2006/0038490 | A1 | 2/2006 | Eden et al. | |
| 2006/0071598 | A1 | 4/2006 | Eden et al. | |
| 2006/0082319 | A1 | 4/2006 | Eden et al. | |
| 2006/0084262 | A1 | 4/2006 | Qin | |
| 2007/0108910 | A1 | 5/2007 | Eden et al. | |
| 2007/0170866 | A1 | 7/2007 | Eden et al. | |

OTHER PUBLICATIONS

L.D. Biborosch et al., "Microdischarges with plane cathodes", *Applied Physics Letters*, vol. 75, No. 25, Dec. 20, 1999, pp. 3927-3928.

J. G. Eden, et al., "Microplasma Devices Fabricated in Silicon, Ceramic, and Metal/Polymer Structures: Arrays, Emitters and Photodetectors", *Journal of Physics D: Applied Physics*, vol. 36, 2003, pp. 2869-2877.

Ahmed El-Habachi et al., "Emission of excimer radiation from direct current, high-pressure hollow cathode discharges", *Appl. Phys. Lett.*, vol. 72, No. 1, Jan. 5, 1998, pp. 22-24.

J.W. Frame et al., "Microdischarge devices fabricated in silicon", *Appl. Phys. Lett.*, vol. 71, No. 9, Sep. 1, 1987, pp. 1165-1167.

J.W. Frame et al., "Planar Microdischarge arrays", *Electronics Letters*, vol. 34, No. 15, pp. 1529-1531, Jul. 23, 1998.

H. Masuda, K. Fukuda, "Ordered Metal Nanohole Arrays Made by a Two-Step Replication of Honeycomb Structures of Anodic Alumina", *Science*, vol. 268, No. 5216, Jun. 9, 1995, pp. 1466-1468.

Abdel-Aleam H. Mohammed et al., "Direct current glow discharges in atmospheric air", *IEEE Transactions on Plasma Science*, vol. 30, No. 1, Feb. 2002, pp. 182-183.

S.J. Park, C.J. Wagner, C.M. Herring, J.G. Eden, "Flexible Microdischarge Arrays: Metal/Polymer Devices", *Applied Physics Letters*, vol. 77, No. 7, Jul. 10, 2000, pp. 199-201.

S.J. Park, C.J. Wagner, J.G. Eden, "Performance of Microdischarge Devices and Arrays with Screen Electrodes", *IEEE Photonics Technology Letters*, vol. 13, No. 1, Jan. 2001, pp. 61-63.

S.J. Park et al, "Independently addressable subarrays of silicon microdischarge devices: electrical characteristics of large (30×30) arrays and excitation of a phosphor", *Applied Physics Letters*, vol. 79, No. 13, Sep. 24, 2001, pp. 2100-2102.

S.J. Park et al., "Arrays of microdischarge devices having 50-100 μm square pyramidal Si anodes and screen cathodes", *Electronics Letters*, vol. 37, No. 3, Feb. 1, 2001, pp. 171-172.

S.J. Park et al., "Carbon nanotube-enhanced performance of microplasma devices", *Applied Physics Letters*, vol. 84, No. 22, May 31, 2004, pp. 4481-4483.

S.J. Park et al., "Silicon microdischarge devices having inverted pyramidal cathodes: fabrication and performance of arrays", *Applied Physics Letters*, vol. 78, No. 4, Jan. 22, 2001, pp. 419-421.

L.C. Pitchford et al., "The breakdown and glow phases during the initiation of discharges for lamps", *J. Appl. Phys.*, vol. 82, No. 1, Jul. 1, 1997, pp. 112-119.

K.H. Schoenbach et al, "Microhollow cathode discharges", *Appl. Phys. Lett.*, vol. 68, No. 1, Jan. 1, 1996, pp. 13-15.

K.H. Schoenbach et al, "High-pressure hollow cathode discharges", *Plasma Sources Sci. Technol.*, vol. 6, 1997, pp. 468-477.

Robert H. Stark et al, "Direct current high-pressure glow discharges", *Journal of Applied Physics* vol. 85, No. 4, Feb. 15, 1999, pp. 171-172.

Robert J. Stark et al, "Direct current glow discharges in atmospheric air", *Applied Physics Letters*, vol. 74, No. 25, Jun. 21, 1999, pp. 3370-3372.

B.A. Vojak et al, "Multistage, monolithic ceramic microdischarge device having an active length of ~0.27 mm", *Applied Physics Letters*, Vol. 78, No. 10, Mar. 5, 2001, pp. 1340-1342.

C.J. Wagner, "Excitation of a microdischarge with a reverse-biased pn junction", *Applied Physics Letters*, vol. 78, No. 6, Feb. 5, 2001, pp. 709-711.

A.D. White "New Hollow Cathode Glow Discharge", *Journal of Applied Physics*, vol. 30, No. 5, May 1959, pp. 711-719.

Sung-Jin Park et ai,, "Microdischarge Arrays: A New Family of Photonic Devices", *IEEE Journal on Selected Topics in Quantum Electronics*, vol, 8, No. 1, Jan./Feb. 2002, pp. 139-147,.

* cited by examiner

LOW VOLTAGE MICROCAVITY PLASMA DEVICE AND ADDRESSABLE ARRAYS

REFERENCE TO RELATED APPLICATION AND PRIORITY CLAIM

This application claims priority under 35 U.S.C. §119 from prior co-pending provisional application Ser. No. 60/812,755, which was filed on Jun. 12, 2006.

STATEMENT OF GOVERNMENT INTEREST

The invention was made with government support under Contract No. F49620-03-1-0391 awarded by the Air Force Office of Scientific Research (AFOSR), and Contract No. NSF DMI 03-28162 awarded by the National Science Foundation (NSF). The government has certain rights in the invention.

FIELD OF THE INVENTION

The invention is in the field of microcavity plasma devices, also known as microdischarge devices or plasma devices.

BACKGROUND

Microcavity plasma devices produce a nonequilibrium, low temperature plasma within, and essentially confined to, a cavity having a characteristic dimension d below approximately 500 μm. This new class of plasma devices exhibits several properties that differ substantially from those of conventional, macroscopic plasma sources. Because of their small physical dimensions, microcavity plasmas normally operate at gas (or vapor) pressures considerably higher than those accessible to macroscopic devices. For example, plasma devices with a cylindrical microcavity having a diameter of 200-300 μm (or less) are capable of operation at rare gas (as well as $N_2$ and other gases tested to date) pressures up to and beyond one atmosphere. In contrast, standard fluorescent lamps, for example, operate at pressures typically less than 1% of atmospheric pressure. High pressure operation of microcavity plasma devices is advantageous. It is well known, for example, that plasma chemistry at higher pressures favors the formation of several families of electronically-excited molecules, including the rare gas dimers ($Xe_2$, $Kr_2$, $Ar_2$, . . . ) and the rare gas-halides (such as XeCl, ArF, and $Kr_2F$) that are known to be efficient emitters of ultraviolet (UV), vacuum ultraviolet (VUV), and visible radiation. This characteristic, in combination with the ability of microplasma devices to operate with a wide range of gases or vapors (and combinations thereof), offers emission wavelengths extending over a broad spectral range. Furthermore, operation of the plasma in the vicinity of atmospheric pressure minimizes the pressure differential across the packaging material when a microplasma device or array is sealed.

Another unique feature of microplasma devices is the large power deposition into the plasma (typically tens of kW/cm$^3$ or more), which is partially responsible for the efficient production of atoms and molecules that are well-known optical emitters. Consequently, because of the properties of microplasma devices, including the high pressure operation mentioned above and their electron and gas temperatures, microplasmas are efficient sources of optical radiation.

Microcavity plasma devices have been developed over the past decade for a wide variety of applications. An exemplary application for an array of microplasmas is in the area of displays. Since single cylindrical microplasma devices, for example, with a characteristic dimension (d) as small as 10 μm have been demonstrated, devices or groups of devices offer a spatial resolution that is desirable for a pixel in a display. In addition, the efficiency for generating, with a microcavity plasma device, the ultraviolet light at the heart of the plasma display panel (PDP) can exceed that of the discharge structure currently used in plasma televisions.

Early microplasma devices were driven by direct current (DC) voltages and exhibited short lifetimes for several reasons, including sputtering damage to the metal electrodes. Improvements in device design and fabrication have extended lifetimes significantly, but minimizing the cost of materials and the manufacture of large arrays continue to be key considerations. Also, more recently-developed microplasma devices excited by a time-varying voltage are preferable when lifetime is of primary concern.

Research by the present inventors and colleagues at the University of Illinois has pioneered and advanced the state of microcavity plasma devices. This work has resulted in practical devices with one or more important features and structures. Most of these devices are able to operate continuously with power loadings of tens of kW-cm$^{-3}$ to beyond 100 kW-cm$^{-3}$. One such device that has been realized is a multi-segment linear array of microplasmas designed for pumping optical amplifiers and lasers. Also, the ability to interface a gas (or vapor) phase plasma with the electron-hole plasma in a semiconductor has been demonstrated. Fabrication processes developed largely by the semiconductor and microelectromechanical systems (MEMs) communities have been adopted for fabricating many of the microcavity plasma devices. Use of silicon integrated circuit fabrication methods has further reduced the size and cost of microcavity plasma devices and arrays. Because of the batch nature of micromachining, not only are the performance characteristics of the devices improved, but the cost of fabricating large arrays is also reduced. The ability to fabricate large arrays with precise tolerances and high density makes these devices attractive for display applications.

This research by the present inventors and colleagues at the University of Illinois has resulted in exemplary practical devices. For example, semiconductor fabrication processes have been adopted to demonstrate densely packed arrays of microplasma devices exhibiting uniform emission characteristics. Arrays fabricated in silicon comprise as many as 250,000 microplasma devices in an active area of 25 cm$^2$, each device in the array having an emitting aperture of typically 50 μm×50 μm. It has been demonstrated that such arrays can be used to excite phosphors in a manner analogous to plasma display panels, but with values of the luminous efficacy that are not presently achievable with conventional plasma display panels. Another important device is a microcavity plasma photodetector that exhibits high sensitivity. Phase locking of microplasmas dispersed in an array has also been demonstrated.

The following U.S. patents and patent applications describe microcavity plasma devices resulting from these research efforts. Published Applications: 20050148270-Microdischarge devices and arrays; 20040160162-Microdischarge devices and arrays; 20040100194-Microdischarge photodetectors; 20030132693-Microdischarge devices and arrays having tapered microcavities; U.S. Pat. No. 6,867,548-Microdischarge devices and arrays; U.S. Pat. No. 6,828,730-Microdischarge photodetectors; U.S. Pat. No. 6,815,891-Method and apparatus for exciting a microdischarge; U.S. Pat. No. 6,695,664-Microdischarge devices and arrays; U.S. Pat. No. 6,563,257-Multilayer ceramic microdischarge device; U.S. Pat. No. 6,541,915-High pressure arc lamp assisted start up device and method; U.S. Pat. No. 6,194,833-Microdischarge lamp and array; U.S. Pat. No. 6,139,384-Microdischarge lamp formation process; and U.S. Pat. No. 6,016,027-Microdischarge lamp.

Additional exemplary microcavity plasma devices are disclosed in U.S. Published Patent Application 2005/0269953, entitled "Phase Locked Microdischarge Array and AC, RF, or Pulse Excited Microdischarge"; U.S. Published Patent Application no. 2006/0038490, entitled "Microplasma Devices Excited by Interdigitated Electrodes;" U.S. Published Patent Application no. 2006/0071598, entitled "Microdischarge Devices with Encapsulated Electrodes,"; U.S. Published Patent Application no. 2006/0082319, entitled "Metal/Dielectric Multilayer Microdischarge Devices and Arrays"; and U.S. patent application Ser. No. 11/042,228, entitled "AC-Excited Microcavity Discharge Device and Method", filed on Jan. 25, 2005.

The development of microcavity plasma devices continues, with an emphasis on the display market and the biomedical applications market. Widespread adoption of microcavity plasma devices in displays will hinge on several critical factors, including efficacy (discussed earlier), lifetime and addressability. Addressability, in particular, is vital in most display applications. For example, for a group of microcavity discharges to act as a pixel, each microplasma device must be individually addressable.

SUMMARY OF THE INVENTION

Microcavity plasma devices and arrays of microcavity plasma devices are provided that have a reduced excitation voltage. A trigger electrode disposed proximate to a microcavity reduces the excitation voltage required between the first and second electrodes to ignite a plasma in the microcavity when gas(es) or vapor(s) (or combinations thereof) are contained within the microcavity.

The invention also provides symmetrical microplasma devices and arrays of microcavity plasma devices for which current waveforms are the same for each half-cycle of the voltage driving waveform. Additionally, the invention also provides devices that have standoff portions and voids that can reduce cross talk. The devices are preferably also used with a trigger electrode.

DETAILED DESCRIPTION OF THE PREFERRED EMBODIMENTS

Figure 1:
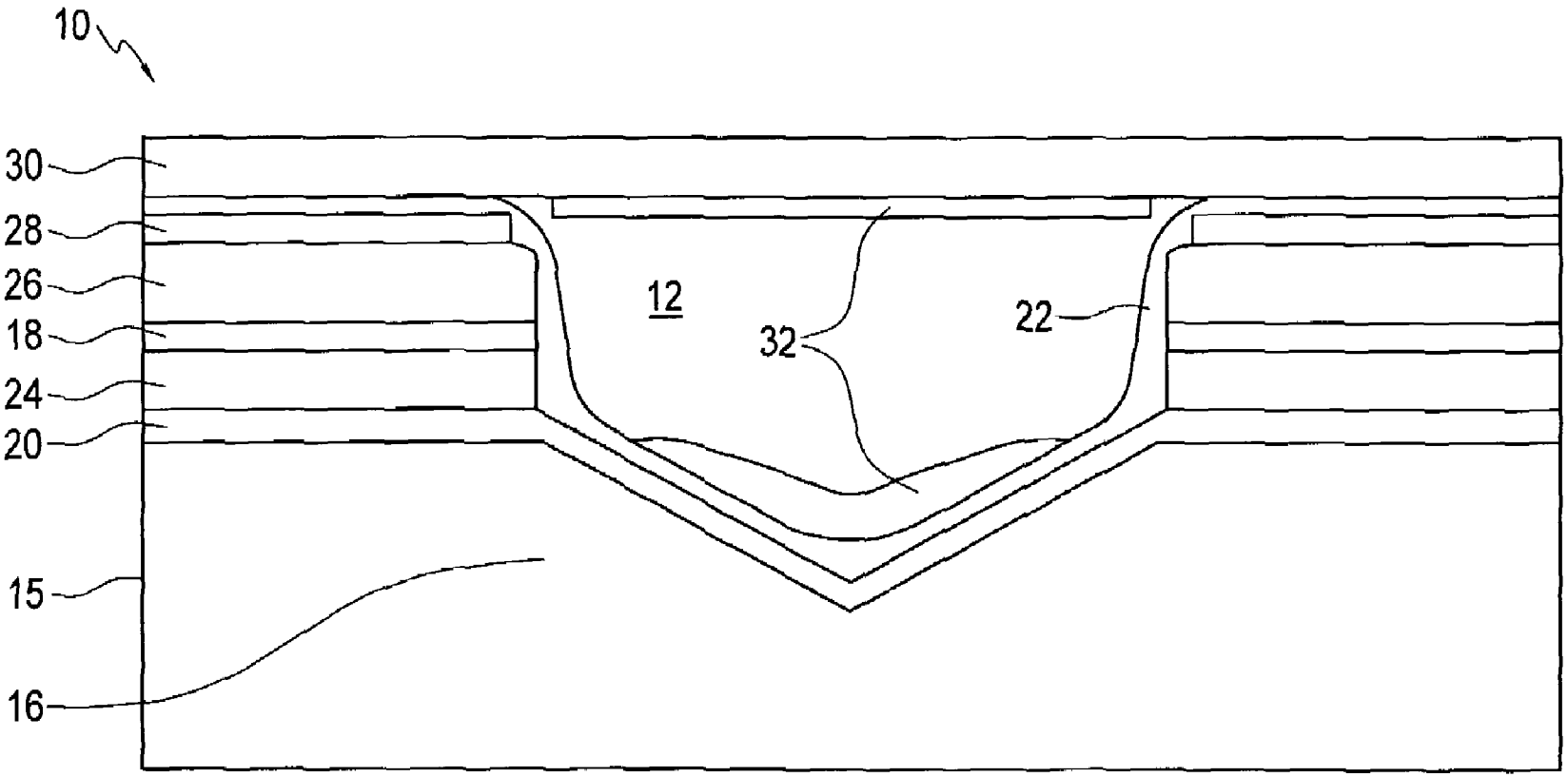
FIG. 1 is a schematic diagram in cross-section of a preferred embodiment low voltage microcavity plasma device of the invention.

With this invention, microcavity plasma devices and arrays of microcavity plasma devices are provided that have a reduced excitation voltage relative to previous devices and arrays. A trigger electrode disposed proximate to a microcavity reduces the excitation voltage required between first and second electrodes to ignite a plasma in the microcavity when gas(es) or vapor(s) (or combinations thereof) are contained within the microcavity. Also provided is a symmetrical microplasma device for which current waveforms are the same for each half-cycle of the voltage driving waveform. Additionally, the invention also provides devices that have standoff portions and voids that can reduce cross talk.

An embodiment of the invention is a microcavity plasma device having a microcavity formed in a substrate. First and second electrodes are disposed to excite a plasma in the microcavity upon application of a time-varying potential (AC, RF, bipolar or pulsed DC, etc.) between the first and second electrodes. The structure of the devices is that of a dielectric barrier configuration in which dielectric films isolate the first and second electrodes from a plasma formed in said microcavity. A trigger electrode disposed proximate to the microcavity reduces the required voltage potential between the first and second electrodes to ignite a plasma. In preferred devices, a controller (power supply) applies a voltage waveform to the trigger electrode to reduce the required operating voltage applied to the first and second electrodes. In a preferred embodiment, the trigger electrode is disposed opposite the microcavity, and is transparent. Another preferred embodiment is an array of microcavity plasma devices with at least one, and preferably all or a substantial percentage, of the microcavity plasma devices in the array including trigger electrodes.

An embodiment of the invention is a microcavity plasma device having a trigger electrode that reduces the excitation voltage required to be supplied to the first and second electrodes of the device. In a preferred embodiment, a substrate has a microcavity formed therein. First and second electrodes are disposed to excite a plasma in the microcavity upon application of a time-varying potential (AC, RF, bipolar or pulsed DC, etc.) between the first and second electrodes. One or more dielectric layers isolates the first and second electrodes from a plasma formed in said microcavity. A trigger electrode is disposed proximate to said microcavity. Upon application of an appropriate small voltage to the trigger electrode, the voltage waveforms applied to the first and second electrodes required to excite a plasma in the microcavity can be of a lower voltage than if the trigger electrode had not been used or was not present.

Devices and methods of the invention provide low-voltage addressable microcavity plasma device arrays. In a preferred embodiment, transparent trigger electrodes are positioned opposite microcavities in an array of microcavity plasma devices. The trigger electrodes can be driven with a small time-varying voltage to produce a substantial reduction in the voltage levels required to be supplied to driving electrodes of the microcavity plasma devices in the array. In an example embodiment, the first electrodes are connected electrically to those of microcavities in a row within an array and the second electrodes are connected electrically to those of microcavities in a column within that array. Individual microcavities in the array are addressed, and addressing can be accomplished with voltage waveforms applied to the trigger electrode.

Preferred embodiments will now be discussed with respect to the drawings. The drawings include schematic figures that are not to scale, which will be fully understood by skilled artisans with reference to the accompanying description. Features may be exaggerated for purposes of illustration. From the preferred embodiments, artisans will recognize additional features and broader aspects of the invention.

FIG. 1 is a cross-sectional diagram of an example embodiment of a low voltage microcavity plasma device 10 of the invention. The device 10 is readily replicated to form arrays of microcavity plasma devices. Large numbers of microcavity plasma devices 10 can be formed to constitute an array of microcavity plasma devices, and devices in such an array can be addressed individually or in one or more groups.

A microcavity 12 is defined in a substrate 15. The microcavity can have any number of shapes. The shape (cross-sectional geometry and depth) of the microcavity, as well as the identity of the gas(es) or vapor(s) in the microcavity 12, the applied voltage and the voltage waveform, determine the plasma configuration within the cavity and the radiative efficiency of a plasma, given a specific atomic or molecular emitter. Example microcavity shapes include cylinders and inverted pyramids. Preferred embodiment devices include microcavities that have tapered sidewalls. Tapered cavities are relatively inexpensive and easy to fabricate using conventional wet chemical processing techniques for semiconductors. The positive differential resistance of devices with tapered sidewalls permits self-ballasting of the devices and simplifies external control circuitry. Microdischarge devices with tapered cavities also offer an increase in microcavity surface area and control over the depth of the microcavity to be fabricated, thereby enabling straightforward modification of the electrical properties of devices as desired. In addition, increased radiative output efficiencies are obtained by coating the tapered side walls with an optically reflective coating or a coating with a relatively small work function. Additional information regarding particular tapered cavities can be found in U.S. Pat. No. 7,112,918, entitled Microdischarge Devices and Arrays Having Tapered Microcavities, which issued Sep. 26, 2006. The inverted pyramidal shape of the microcavity 12 in FIG. 1 represents a preferred embodiment and is shown in FIG. 1 and other embodiments to be discussed below.

Substrate 15 can be formed of any material amenable to semiconductor fabrication processes, including semiconductor, conductor or insulator materials. However, the inverted pyramidal microcavity of FIG. 1 is formed with precision and economically if substrate 15 is silicon, which is the material of choice in preferred embodiments. In the device 10 of FIG. 1, the substrate 15 is conductive and forms a first electrode 16, which is isolated from a second electrode 18 by dielectric, and dielectric also isolates the electrodes 16 and 18 from the cavity 12. Specifically, a multi-layer dielectric including first dielectric layers 20, 22 and second dielectric layers 24, 26 achieve the isolation. The dielectric layers 20, 22 and 24, 26 can be, for example, metal oxide, $SiO_2$, $Si_3N_4$, or polymer layers. The first and second dielectric layers are preferably formed of different materials. Dielectric performance can be improved with multiple dielectric layers of different materials. In one preferred embodiment of the invention, dielectric films 20 and 22 are $SiO_2$ or $Si_3N_4$ whereas dielectric 24 is a polymer, e.g., polyimide.

Trigger electrode 28, which serves to reduce the voltage required to ignite a plasma in microcavity 12, is also electrically and physically isolated from the microcavity and the other two electrodes by a multilayer dielectric. The trigger electrode 28 in device 10 is disposed adjacent to microcavity 12 and yet is isolated from the microcavity by the dielectric layer 22. A gas or gases, vapor or vapors, or combinations of gas(es) and vapor(s), is sealed in the microcavity by a transparent layer 30, e.g., glass or plastic. Phosphor 32, disposed within the microcavity 12, is useful, for example, to produce color displays. Additionally, the color of an emission from the microcavity is influenced by the type of gas(es) and vapor(s) in the microcavity. The device 10 of FIG. 1 is readily replicated to form an array of low voltage microcavity plasma devices.

Figure 2:
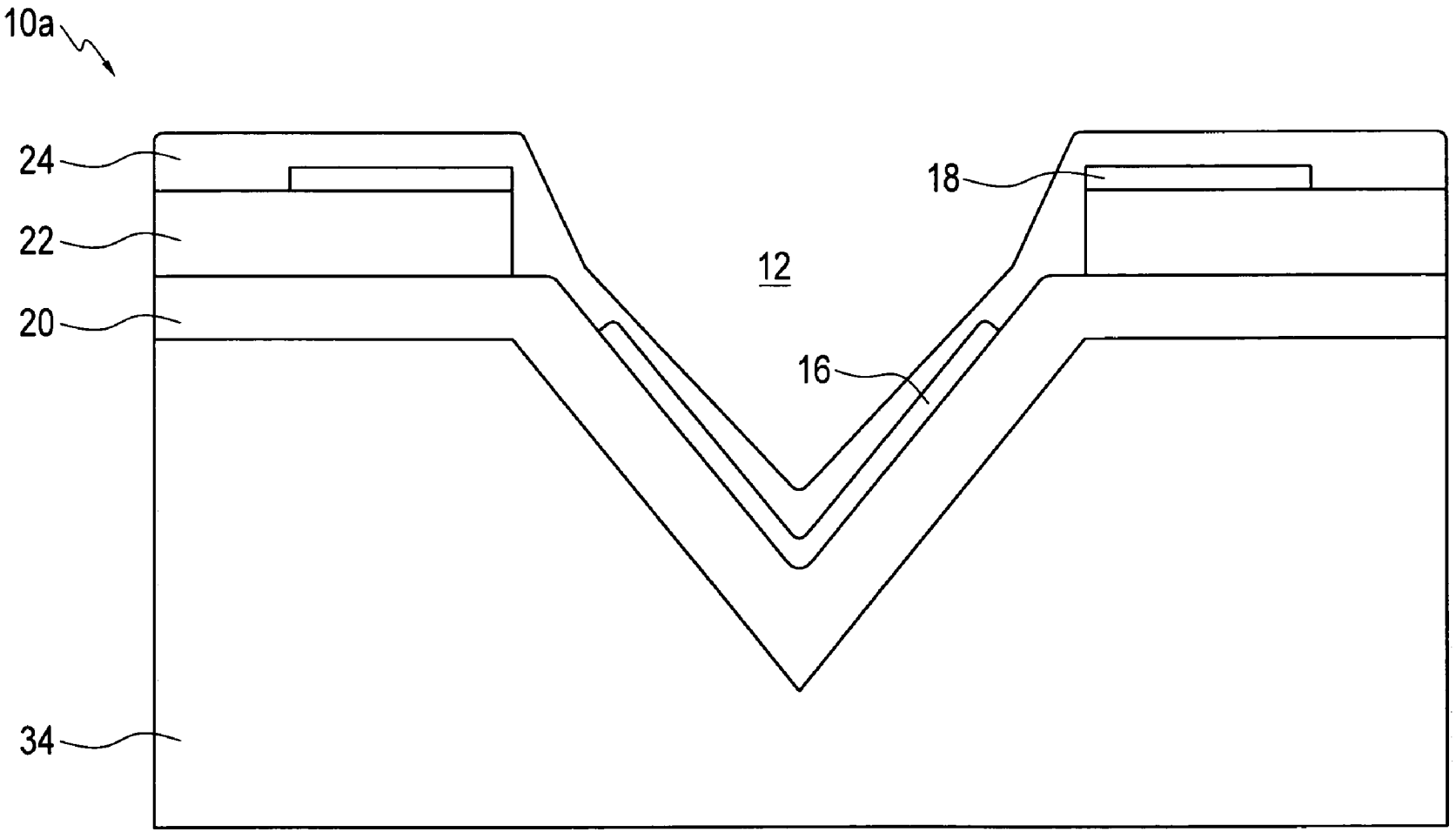
FIG. 2 is a schematic cross-sectional diagram showing a two electrode microcavity plasma device that provides a base structure for the embodiments of FIGS. 3-5.

FIG. 2 is a schematic diagram in cross-section showing another low voltage microcavity plasma device **10*a* that exhibits several differences from the FIG. 1 embodiment. The trigger electrode 28 and transparent layer 30 are not shown in the partial view of FIG. 2. Other parts of the device 10*a* are labeled with the same reference numbers used in FIG. 1 to indicate similar parts of the structure. In the device of FIG. 2, the first electrode 16 is metal layer. In the device of FIG. 2, a substrate 34 is a semiconductor (e.g., silicon), ceramic, or an insulator (e.g., silicon dioxide). The first electrode 16 and second electrode 18 are electrically and physically isolated from each other and the microcavity 12 by dielectric films 20, 22, and 24. As in FIG. 1, additional dielectric 26 (not shown in FIG. 2) could be used to insulate a trigger electrode (not shown in FIG. 2) as in device 10 of FIG. 1**.

Figure 3:
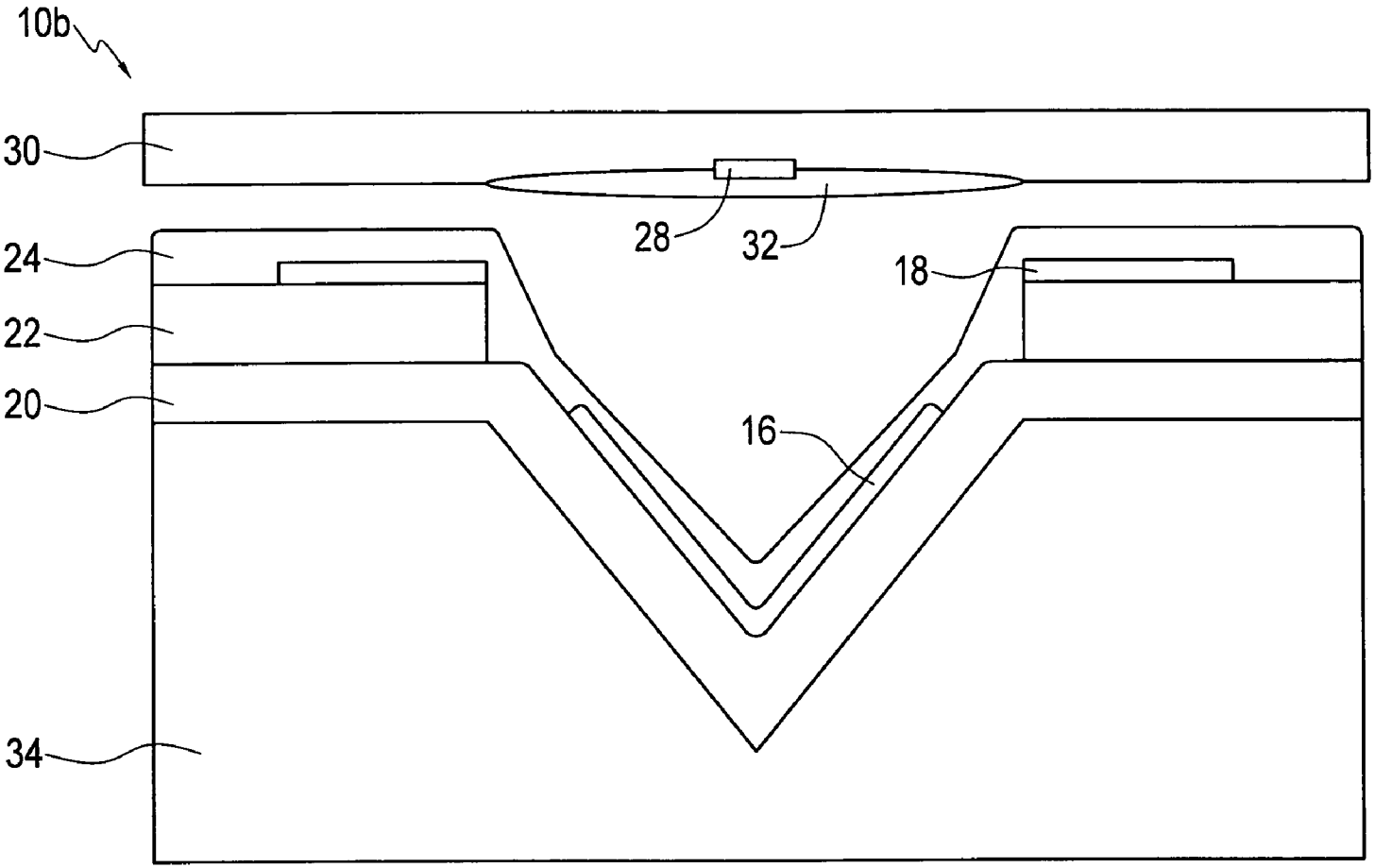
FIG. 3 is a schematic cross-sectional diagram of another preferred embodiment low voltage microcavity plasma device of the invention.

FIG. 3 shows a preferred embodiment low voltage microcavity plasma device **10*b* that is built on the partial structure 10*a* of FIG. 2. Parts that are is similar to devices 10 and 10*a* are labeled with reference numbers from FIGS. 1 and 2. In the FIG. 3 embodiment, the trigger electrode 28 is disposed opposite the microcavity and is deposited onto the transparent layer 30. Electrode 28 is also itself preferably transparent in the visible and can be fabricated, for example, from indium tin oxide. Separating layer 30 from dielectric 24 permits, for example, gases and/or vapors to be sealed in groups of microcavities or throughout all microcavities in an array, i.e., gases and/or vapors are free to flow between different microcavity plasma devices 10*b*. The transparent layer fixes the trigger electrode opposite the microcavity 12. If trigger electrode 28 is not transparent, it is patterned to have a width small compared to the emitting aperture of microcavity 12 so as to block as little of the emission emanating from the microcavity as possible. Trigger electrode 28 may also be connected to other microcavities (not shown in FIG. 3) in which case electrode 28 in FIG. 3** would be fabricated as a line perpendicular to the page of the figure.

Figure 4:
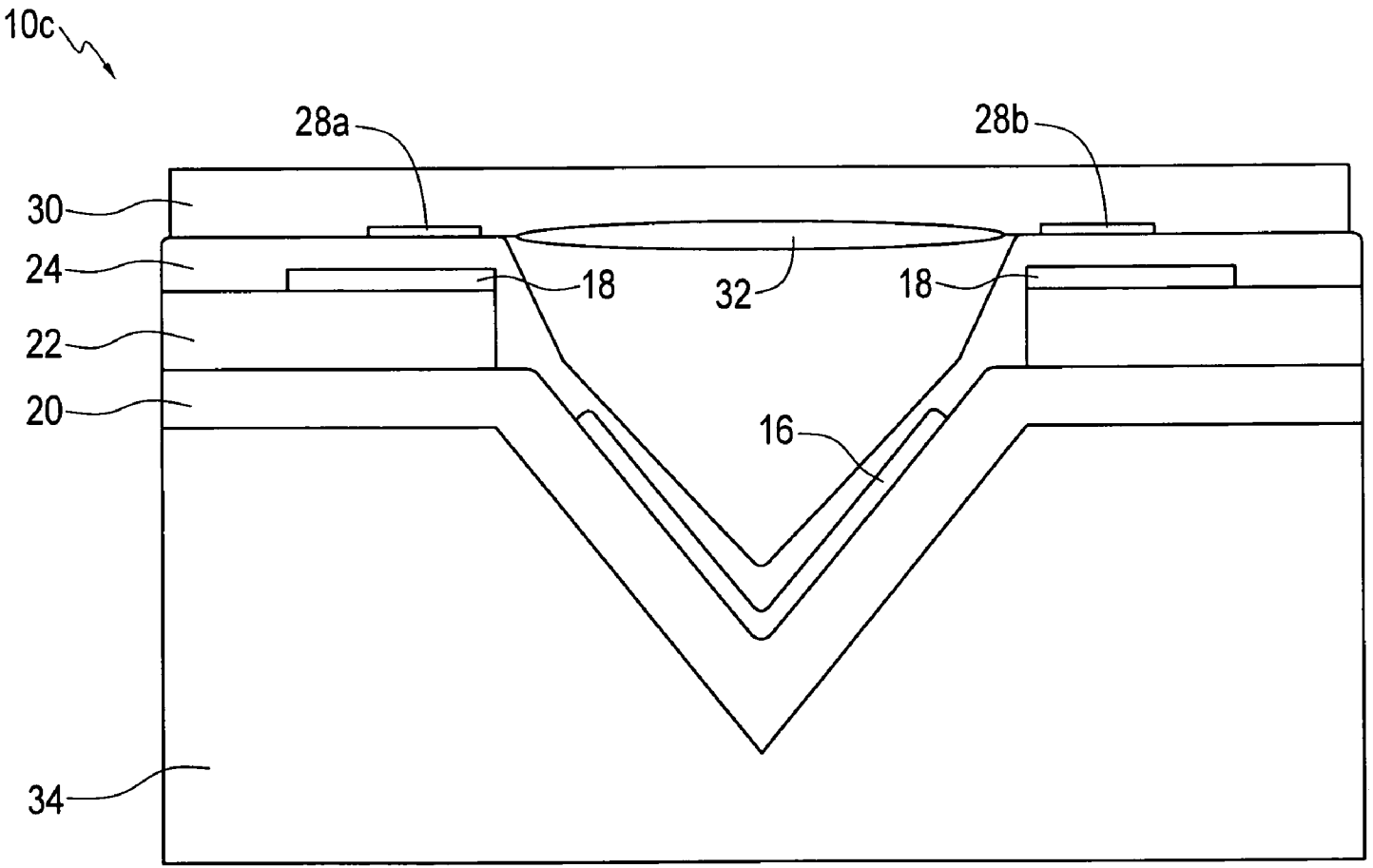
FIG. 4 is a schematic diagram in cross-section of another preferred embodiment low voltage microcavity plasma device of the invention.

FIG. 4 illustrates another preferred embodiment low voltage microcavity plasma device 10*c* built on the partial structure 10*a* of FIG. 2. Parts that are similar to the devices 10, 10*a* and 10*b* are labeled with reference numbers from FIGS. 1-3. In the FIG. 3 embodiment, addressing of individual devices in an array can be achieved by the addressing electrodes 28*a* and 28*b*. Plasma is only ignited in an individual microcavity with an appropriate voltage applied between the first and second electrodes 16, 18 in addition to the addressing/trigger electrodes 28*a*, 28*b*. Phosphor 32 is again optionally located on the interior surface of layer 30 and can also coat the lower portion of microcavity 12, if desired.

Figure 5:
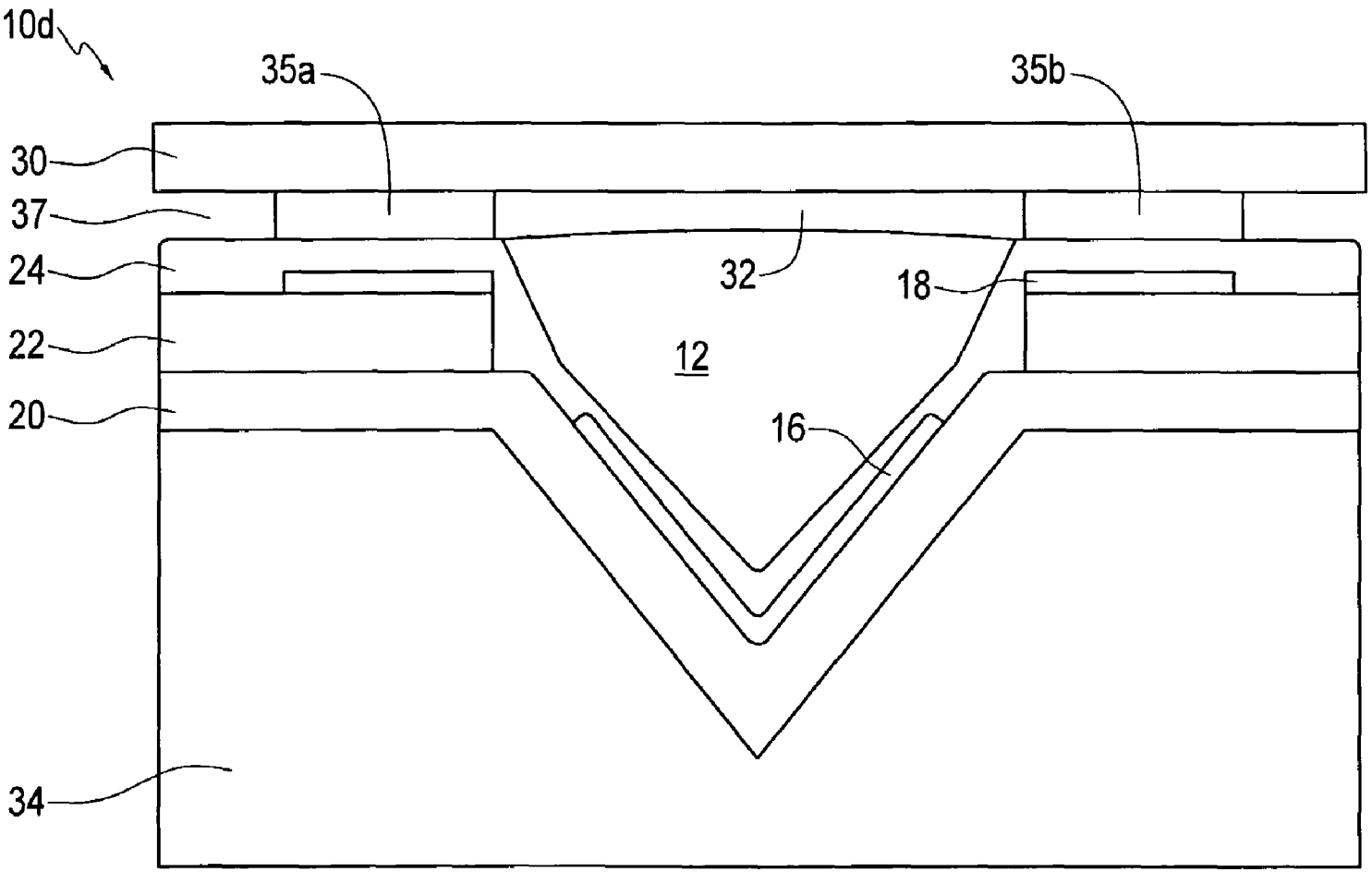
FIG. 5 is a schematic cross-sectional diagram of another preferred embodiment low voltage microcavity plasma device of the invention.

An additional similar embodiment low voltage microcavity plasma device 10*d* is shown in FIG. 5. In this embodiment, the phosphor coating 32 is thicker than that of FIG. 4. Standoff portions 35*a* and 35*b* provide separation between the layer 30 and the dielectric 24 and can either be trigger electrodes or a dielectric wall to prevent cross-talk between pixels. These portions also create void areas 37 around the microcavity 12, which can be used as a gas gap to prevent cross talk or as a bonding area, e.g., for glass device packaging.

Figure 6:
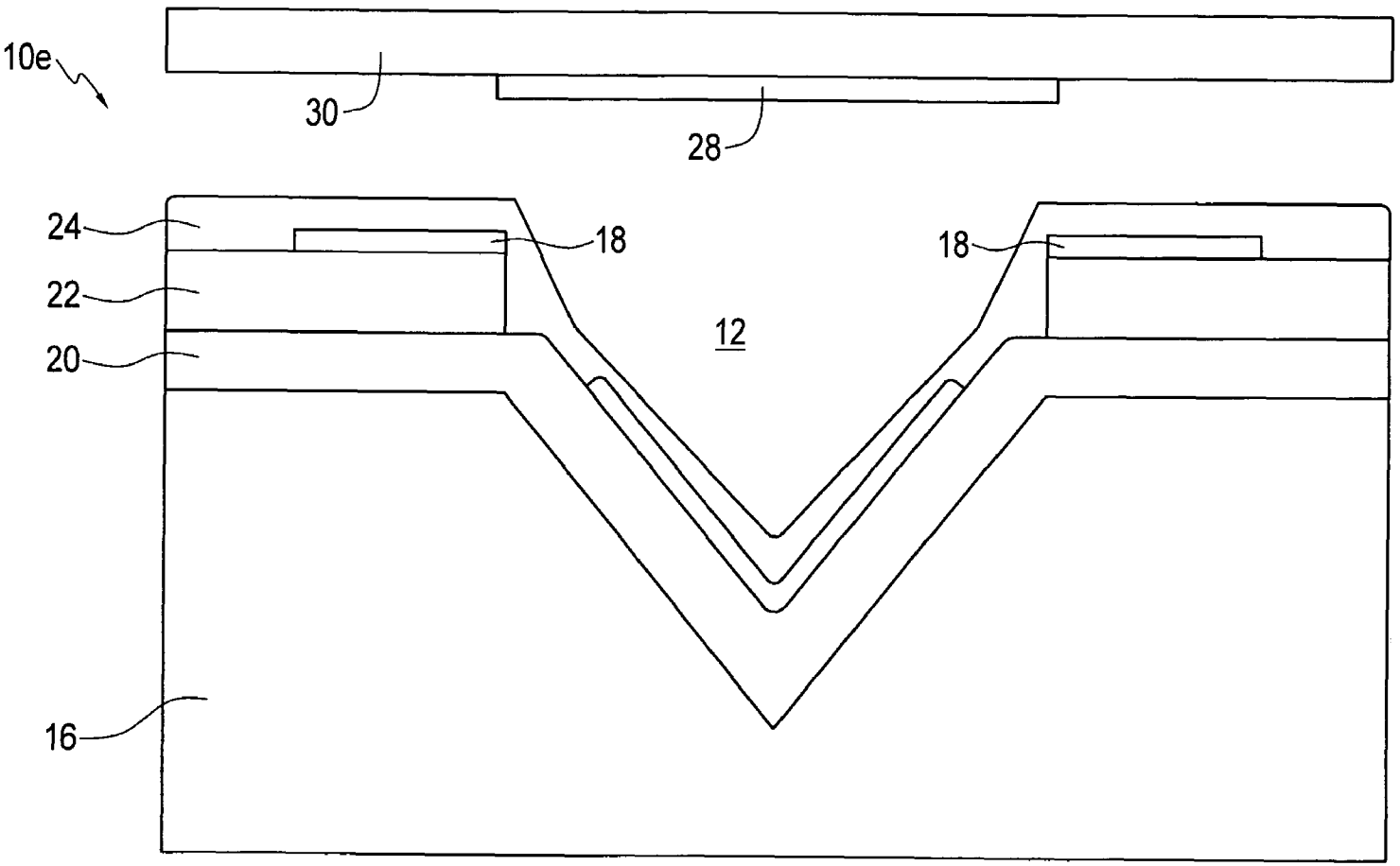
FIG. 6 is a schematic cross-sectional diagram of another preferred embodiment low voltage microcavity plasma device of the invention.

FIG. 6 shows another low voltage microcavity plasma device 10*e* embodiment. The trigger electrode 28 is sufficiently wide to span microcavity 12 and is formed of transparent material. The separation of the transparent layer 30 from the microcavity 12 is preferably about 500 μm or less.

Figure 7:
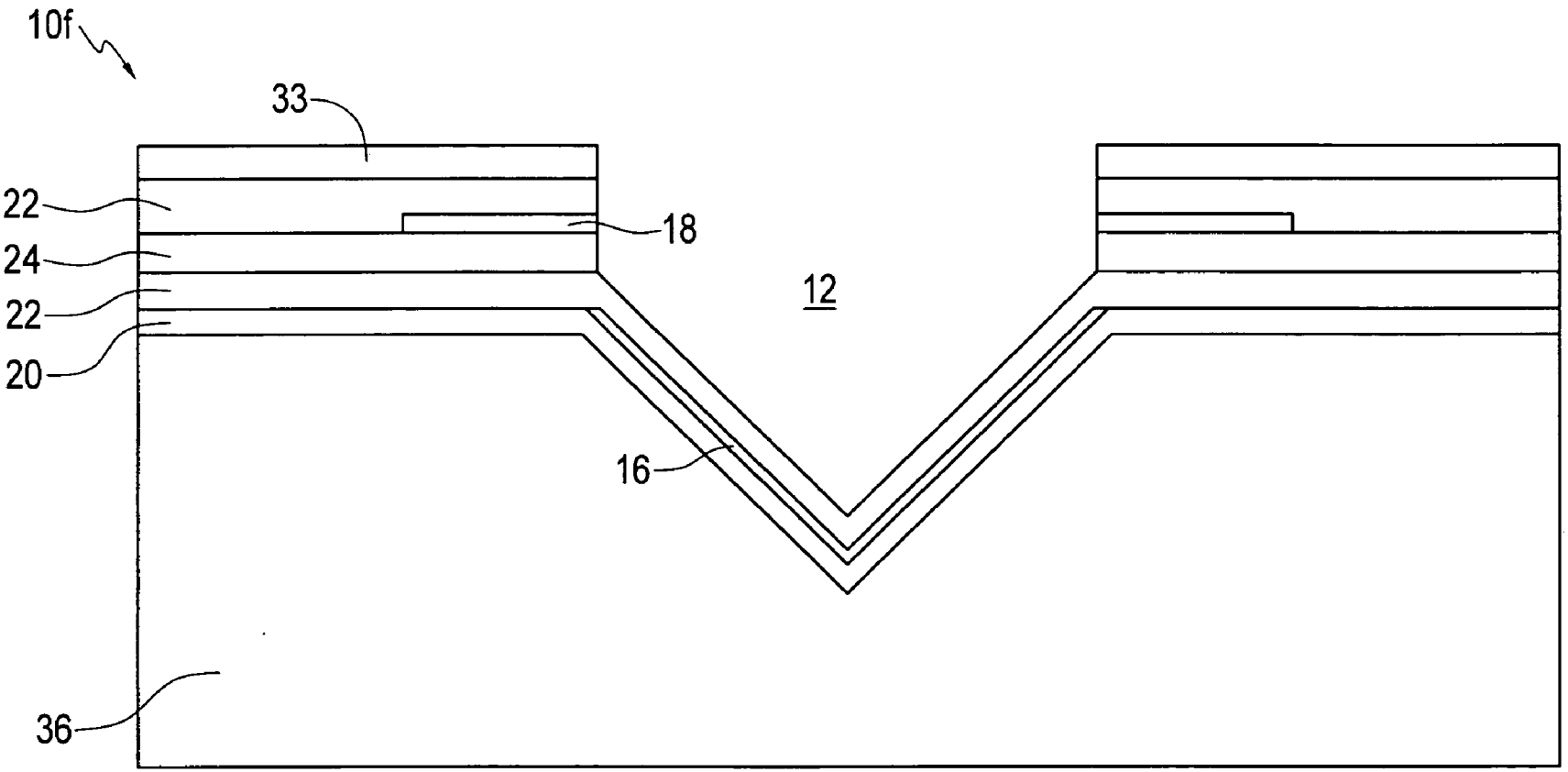
FIG. 7 is a cross-sectional diagram of an additional embodiment of the microcavity plasma device of the invention.

Another embodiment microcavity plasma device 10*f* of the invention is illustrated in cross-section in FIG. 7. The primary difference between this structure and that of FIG. 2 is the addition of another dielectric layer 33 above the electrodes 18 and within the microcavity 12. Experimental tests indicate that this design is effective in containing the plasma within the inverted pyramidal microcavity 12. Measurements also indicate no detrimental effects (such as an increased firing voltage) arising from the additional dielectric layer. In a preferred embodiment, the layer 33 is a polymer, e.g., polyimide and is relatively thick (~2-15 μm). Alternating polymer and nitride dielectric layers have shown good performance in experimental embodiments. In a preferred embodiment, layers 20, 22 are nitride layers and layers 24, 33 are polymer layers. In other embodiments, the dielectric layers are formed of ceramic materials. One particular example embodiment has the layer 33 formed of a low temperature melting glass layer, and it can serve as both a dielectric layer and an adhesive to bond a layer such as layer 30 (not shown in FIG. 7).

Figure 8:
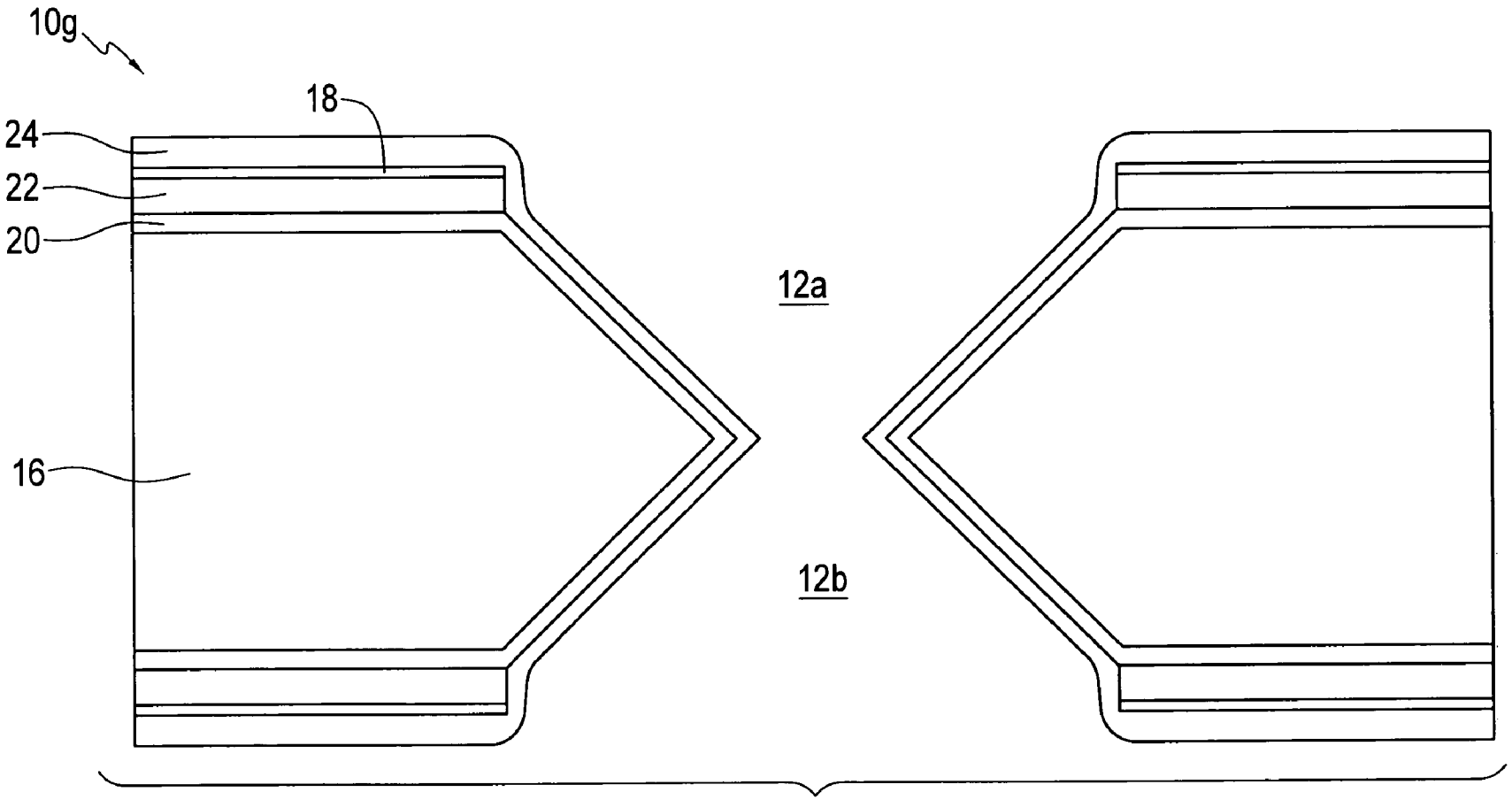
FIG. 8 is a cross-sectional diagram of an embodiment of the invention that is symmetric, having a double-sided structure.

Another preferred embodiment of the microplasma device 10*g* is illustrated in cross-section in FIG. 8. This device 10*g* is double-sided (symmetrical) with two connected cavities 12*a*, 12*b* and, therefore, produces identical current waveforms in each half cycle of the driving voltage waveform. To fabricate this structure requires a thin substrate 16 (preferably silicon) such that etching of the pyramidal microcavities 12*a*, 12*b* will breach the Si wafer completely. That is, a hole is formed that is centered on the apex of the two square pyramids. The opening produced by the wet etching process in silicon (100) wafers has a square cross-section. The device of FIG. 8 operates by using the Si substrate 16 as an electrode common to both microcavity devices. The second electrode 18 for each of the two devices is the conducting layer lying at the edge of the microcavity opening. Thus, a source of time-varying voltage can be connected to the device of FIG. 8 in such a way that on each half-cycle of the voltage waveform, one of the two Si microcavities acts as the cathode. The cavity serving as the cathode switches each half cycle. The dielectric layers in FIG. 8 are the same as those of FIG. 6 and are labeled with similar reference numbers. Another advantage of the structure of FIG. 8 is that a portion of the light produced by the microplasma in either cavity is coupled into the other cavity. Therefore, by placing an optically reflective surface above or below the device of FIG. 8, more light can be obtained than is available from either microcavity alone.

Figure 9:
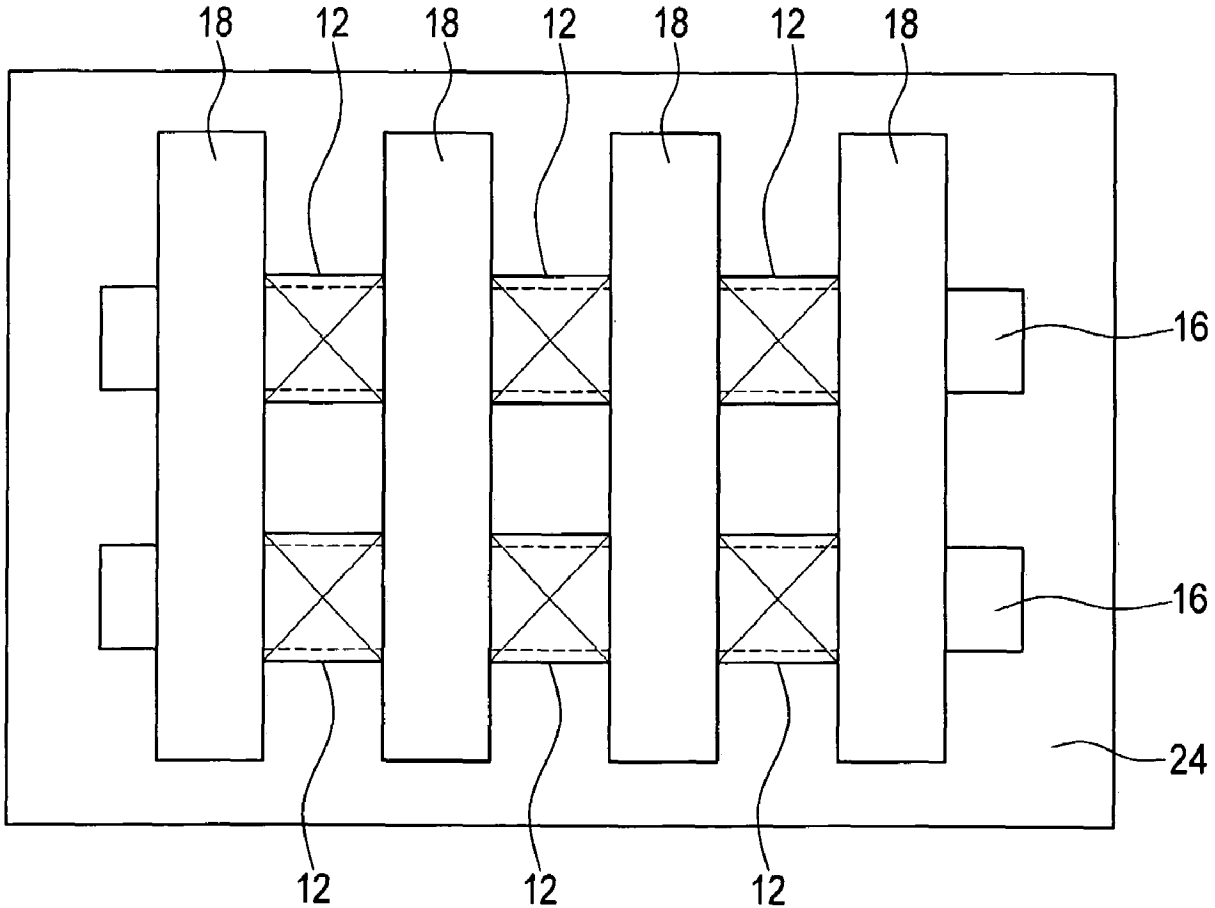
FIG. 9 is a schematic diagram illustrating a top (plan) view of a portion of a preferred embodiment array of low voltage microcavity plasma devices of the invention.

FIG. 9 shows a bottom portion (transparent layer 30 and trigger electrode 28 not shown) of an array of microcavity plasma devices generally in accordance with FIG. 5. The first electrodes 16 are patterned in the microcavities 12 as indicated in FIG. 5. The first and second electrodes, respectively, interconnect rows and columns of microcavities. The trigger electrodes (see FIG. 5) can be formed over rows or columns of the microcavities 12 in the array. Large scale arrays can be fabricated.

Figure 10:
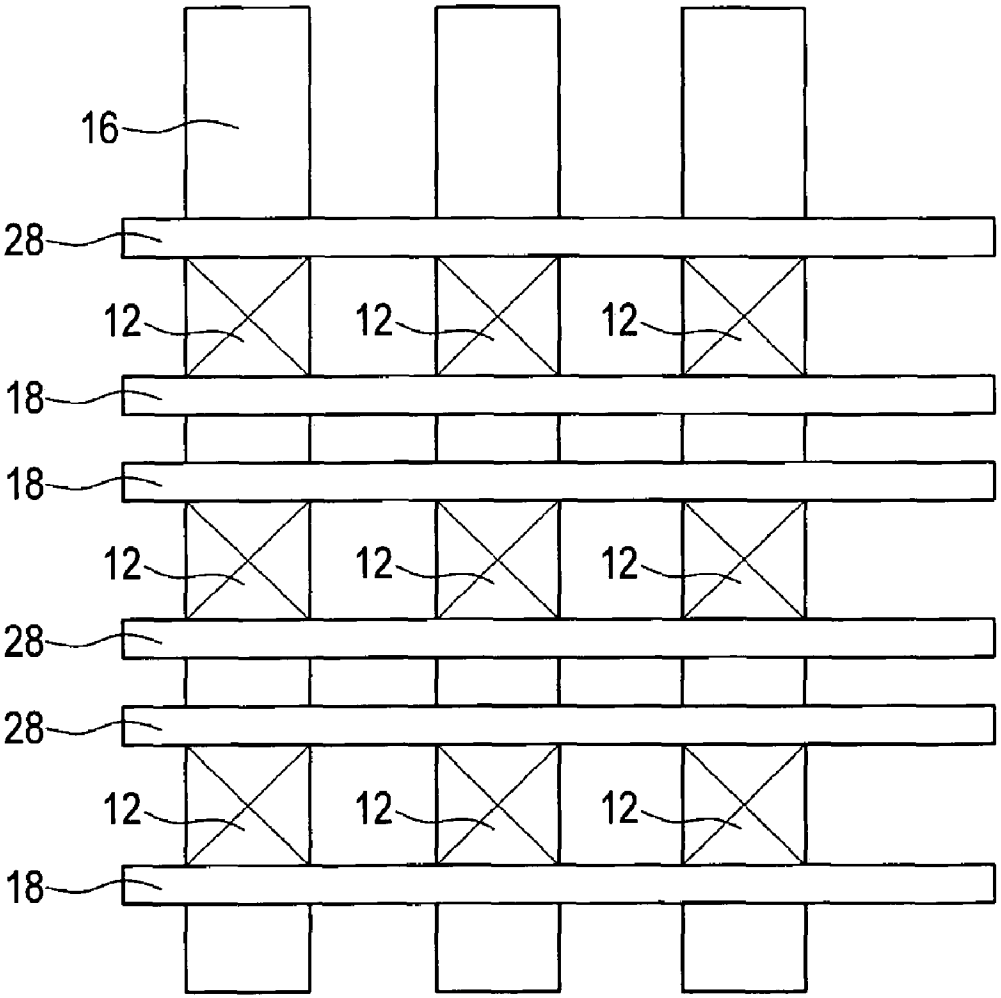
FIG. 10 is a schematic diagram illustrating a top (plan) view of a portion of a preferred embodiment array of low voltage microcavity plasma devices of the invention.
Figure 11:
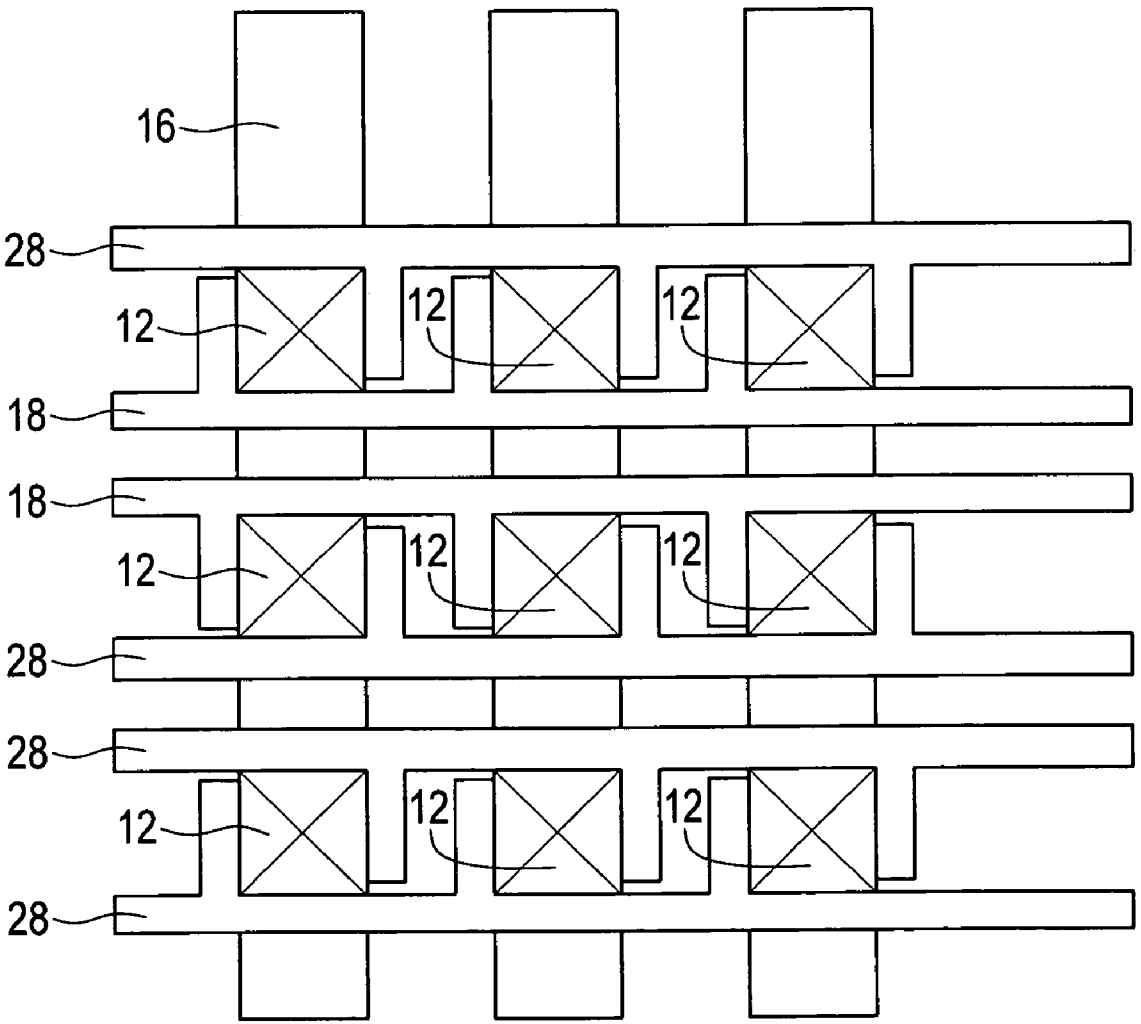
FIG. 11 is a schematic diagram illustrating a top (plan) view of a portion of a preferred embodiment array of low voltage microcavity plasma devices of the invention.

FIGS. 10 and 11 illustrate alternative interconnect patterns for arrays of microplasma devices. In FIG. 10, first electrodes 16 are again patterned in the microcavities 12 but the second electrodes 18 now consist of two parallel but separate conducting lines. One pair, lying between adjacent microcavities, can serve as trigger electrodes for the two cavities bordering the electrode pair. The second pair of parallel electrodes can then serve as the second electrode 18 to sustain the plasma in a device. Notice that the two sets of electrodes are interlaced (i.e., alternating). FIG. 11 presents another interconnection scheme in which each of the electrode lines in FIG. 10 is patterned so as to border the aperture of the microcavity along two of its four sides.

In all of the embodiments, a discharge medium (gas, vapor, or combination thereof) is contained in the microcavities 12 and microplasmas are produced within the microcavities 12 when a time-varying voltage waveform having the proper RMS value is supplied to electrodes 16 and 18. The driving voltage may be sinusoidal, bipolar DC, or unipolar DC, for example. Application of another voltage waveform to the trigger electrodes 28, 28*a* reduces the RMS value required to be supplied to the first and second electrodes 16, 18.

Devices and arrays can be sealed by any suitable material, which can be completely transparent to emission wavelengths produced by the microplasmas or can, for example, filter the output wavelengths of the microcavity plasma devices and arrays so as to transmit radiation only in specific spectral regions. The transparent layer 30 illustrated in the various embodiments can be, for example, a thin glass, quartz, or plastic layer. The pressure of the discharge medium can be maintained at or near atmospheric pressure, permitting the use of a very thin glass or plastic layer because of the small pressure differential across the transparent layer 30.

Experimental Devices and Waveforms for Low Voltage Operation

Example experimental devices have been fabricated to demonstrate the invention. Trigger electrodes substantially reduce the voltages required by driving electrodes, e.g., address and sustain electrodes, to ignite a plasma. Small voltage pulses applied to the trigger electrodes show a substantial benefit in a reduction of the driving voltage, which is advantageous in many applications. Microcavity plasma devices of the invention can form the basis for small and large scale high resolution displays.

Experimental data and devices are presented here and illustrate exemplary embodiments. The experimental devices are readily produced in larger formats, as will be appreciated by artisans. Many additional features, aspects and embodiments of the invention will be apparent to artisans. Artisans will recognize additional features and variations, as well as broader aspects of the invention from the data and description presented herein.

Example experimental device structures were fabricated on a Si wafer and included a bottom electrode, which enters each pyramidal Si device and runs along the bottom of the pyramid. This is similar to the structure shown in FIG. 2. The device is powered by two electrodes, the first of which is a 50-100 μm wide Ni strip that passes through the microcavity and on to the next device. After depositing a multilayer dielectric on top of the first electrode, a second Ni electrode is then patterned onto the device (near the periphery of each microcavity).

In experiments, electrodes were 100-200 μm wide. Electrodes of this width are easier to align with the trigger electrode and transparent layer. Wide electrodes are also beneficial, as the increased electrode area allows for larger currents, significantly improved array brightness, and a more symmetric plasma produced in each pixel. Also, this structure is free of crosstalk. In the experimental devices, the electrode width is a bit larger than that of the microcavity, leading to the production of plasma outside the mouth of each microcavity. Although the pyramidal microcavity has an aperture of 100×100 $\mu m^2$, the aperture narrows to $(\sim 70\ \mu m)^2$ because of the dielectric and electrode films overcoating the cavity. Arrays with 70 μm wide electrodes have also been fabricated to confine the plasma in the microcavity. Artisans will appreciate that commercial semiconductor fabrication techniques are well suited to readily align small width electrodes with microcavities and with associated trigger electrodes for all of the illustrated embodiments, and for other low voltage arrays of microcavity plasma devices of the invention.

A particular experimental array of microcavity plasma devices was an array of 20×20 microcavity plasma devices. The microcavities in the experimental device had bottom electrodes that were 100 μm in width and were operated at 600 Torr Ne. During operation, the array showed high uniformity of emission within each microcavity but a slight grading of the intensity across an array of devices. This nonuniformity is attributed to the resistivity of the electrodes because the film thickness of the electrodes was only 0.15 μm. Increased electrode thickness (e.g. >0.35 μm) is expected to improve further the uniformity of emission across the array.

Experiments did demonstrate a substantial reduction in the voltage required to ignite a plasma in the microcavities. Specifically, the ignition voltage for Ne/5% Xe mixtures (600 Torr) is only 180 V for devices with 100 μm wide bottom electrodes. Devices that are otherwise similar but lacking a trigger electrode required 200 V.

Figure 12:
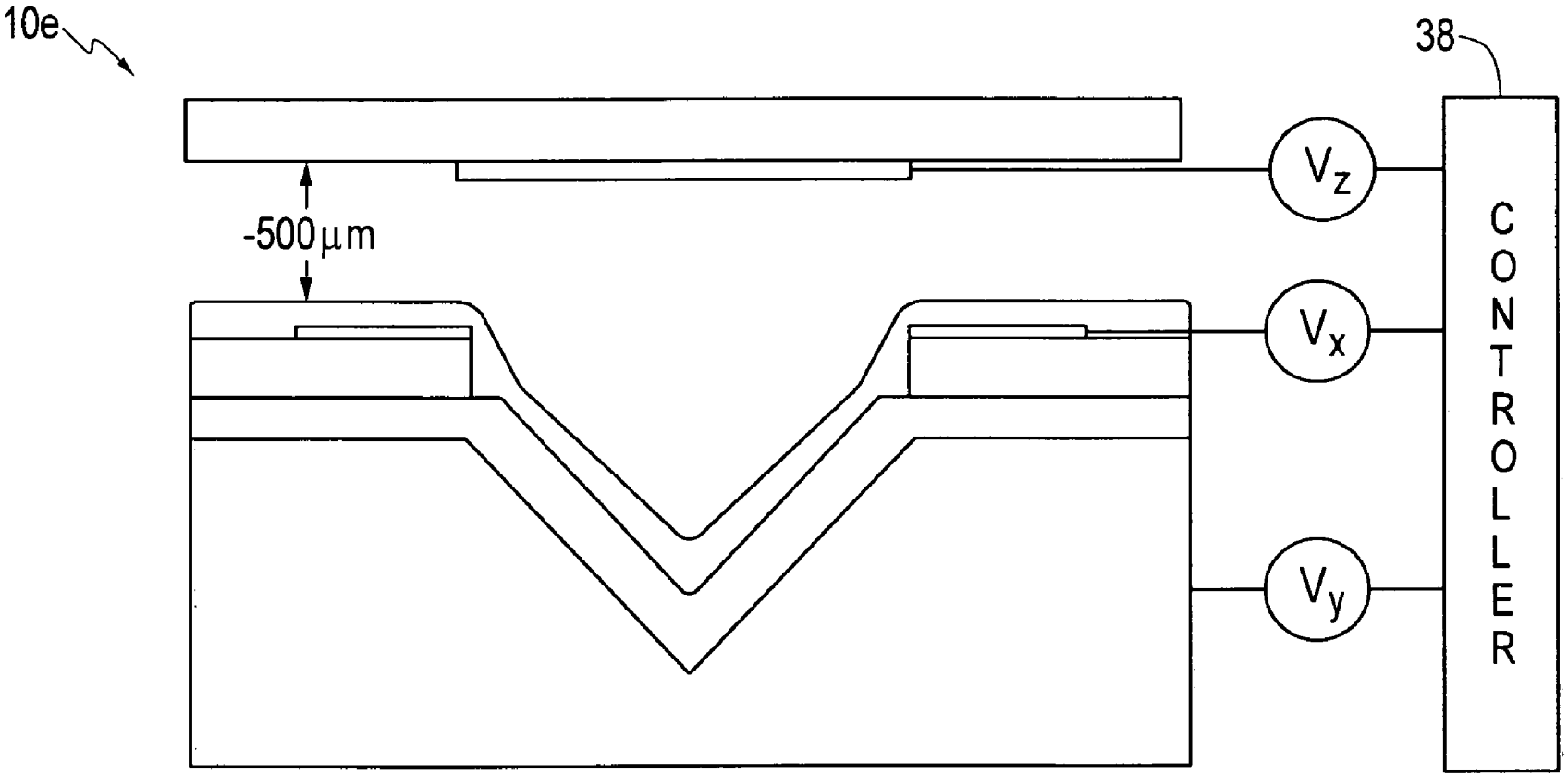
FIG. 12 illustrates the convention for application of voltage waveforms during testing of a prototype 50×50 array of microcavity plasma devices having the structure of the FIG. 6 device.
Figure 13:
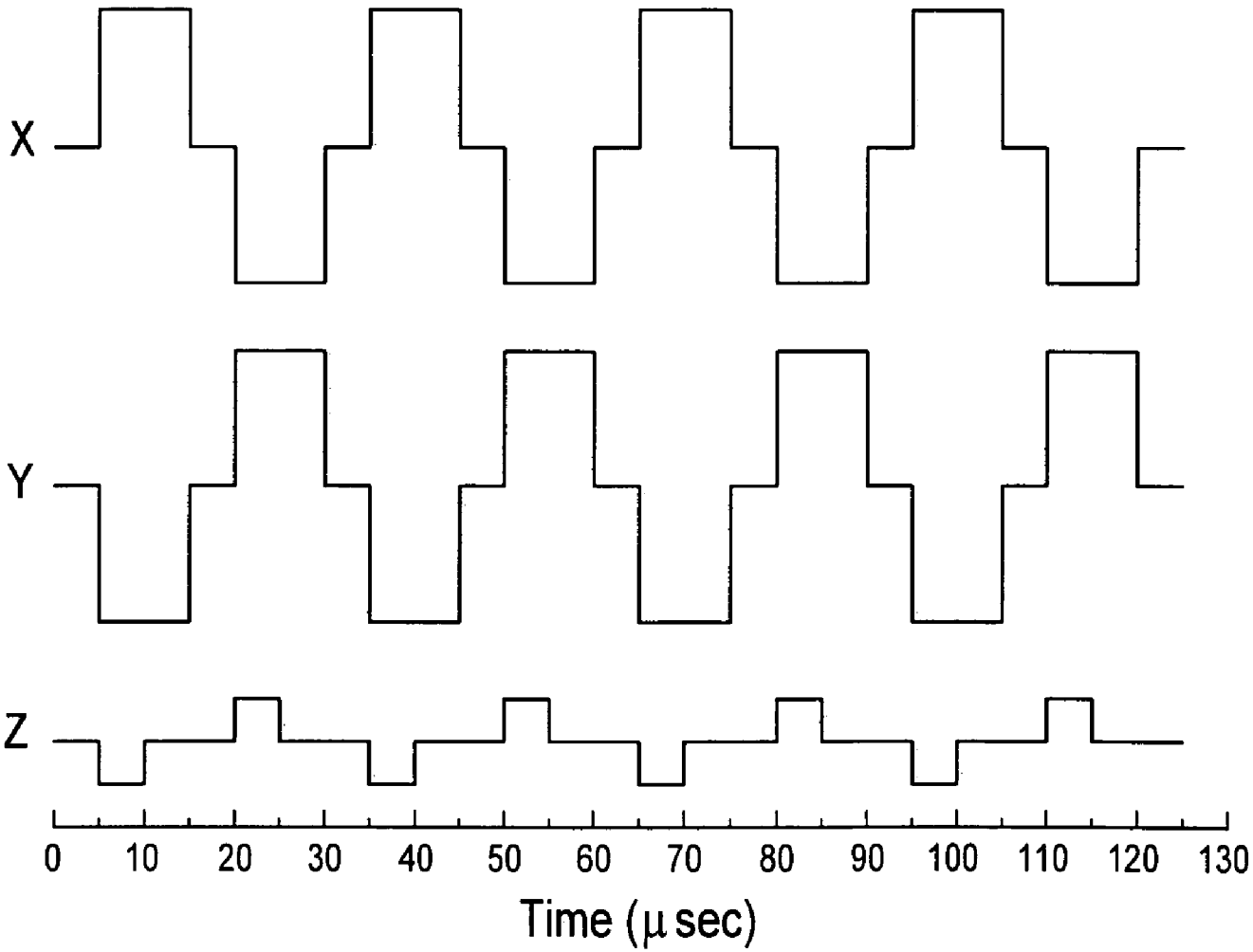
FIG. 13 shows voltage waveforms applied during testing of the prototype 50×50 array of microplasma devices having the structure of the FIG. 6 device.

50×50 arrays of experimental devices having the three-electrode device configuration of the embodiment shown in FIG. 6 were tested in detail. FIG. 12 illustrates the convention for the application of voltage waveforms during testing as would be applied by a controller 36 to reduce the required voltage to ignite a plasma. FIG. 13 shows the voltage waveforms applied by the controller during testing. The voltage waveforms applied to electrodes X and Y were chosen to be mirror images of one another, as shown in FIG. 13. Each pulse (positive or negative) has a temporal width of 10 μsec. Because of the proximity of electrodes Z and X (an ITO film and Ni electrode, respectively), electrode Z serves as a trigger electrode and the lowest waveform in FIG. 13 is that supplied to electrode Z for the tests to date. Table I presents the results of ignition tests with the 50×50 pixel array. With no voltage waveform applied to electrode Z, array ignition requires both $V_x$ and $V_y$ to be 165 V. Surprisingly, supplying only 40 V pulses to electrode Z reduces $V_y$ by 25 V and $V_x$ by 5 V. Further increases in the voltage delivered to the address electrode result in the required value of $V_y$ dropping by as much as 42 V. The minimum address electrode voltage measured in testing (when using the trigger electrode) is well below the 80-100 V typically required to address the plasma pixels in a conventional plasma display panel (PDP). It was also found (Table II) that increasing the widths of the pulses supplied to the address electrode (Z) beyond 2-5 μsec had little effect on array performance.

Figure 14:
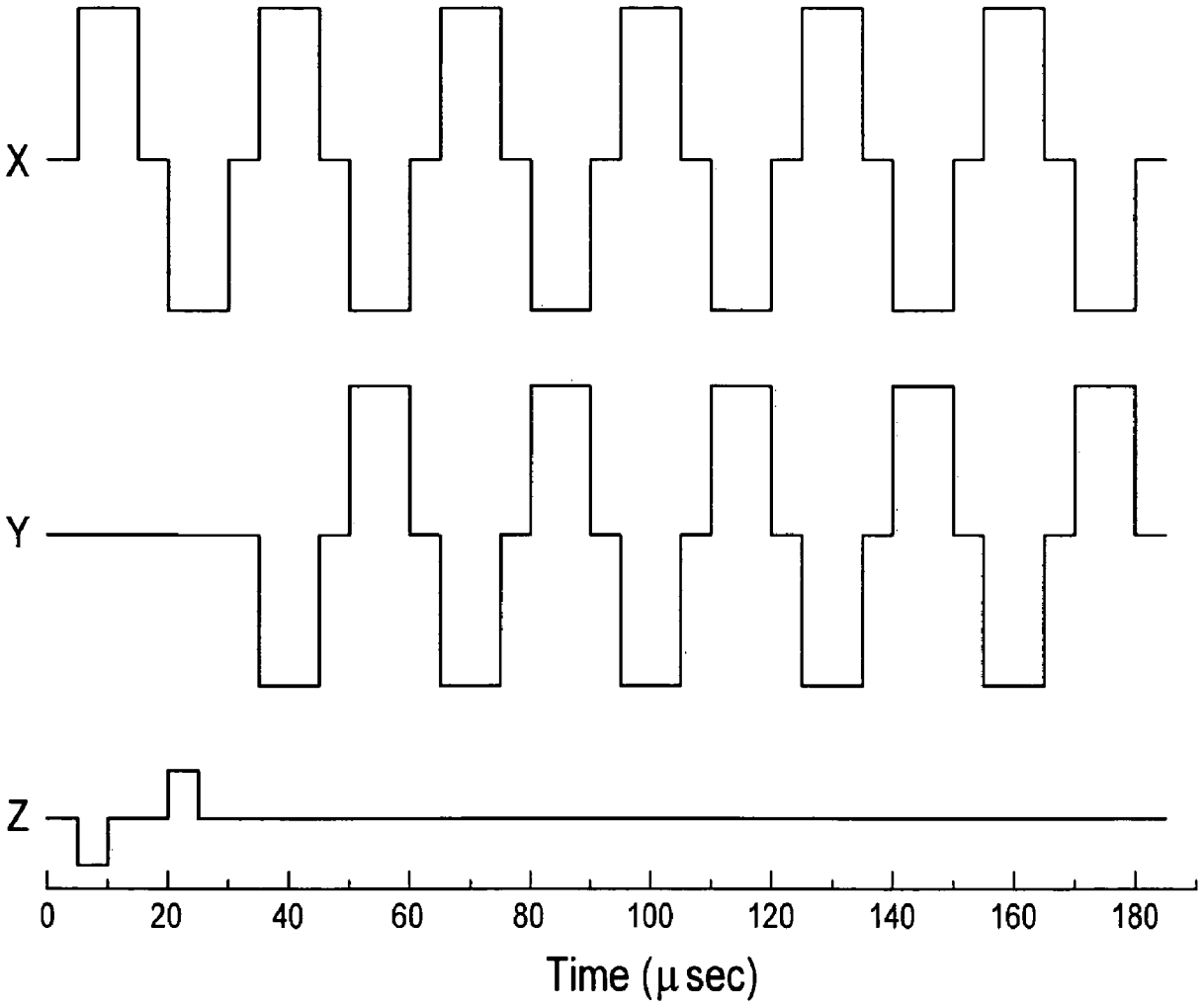
FIG. 14 shows an alternative set of voltage waveforms applied during testing of the prototype 50×50 array of FIG. 9.

Use of the trigger electrode as an address electrode is so effective that it was possible to sustain the array with the waveforms illustrated in FIG. 14. Notice that in FIG. 14 that a five-cycle sequence of waveforms identical to those of FIG. 13 is applied to electrodes X and Y, but only one cycle is delivered to the address (trigger) electrode.

Additional variations to the embodiments discussed earlier include: 1) decreasing the Z-X electrode gap (at ~0.5 mm in example prototypes) in order to reduce the address voltage further, and 2) exploiting the pressure dependence of the switching behavior of these arrays. The rise and fall times of the plasma fluorescence, and analyzing the effect on discharge properties of varying the drive waveforms, are also of interest. Experiments have been carried out thus far with Ne gas and $Ar/D_2$ mixtures to produce ultraviolet emission from the argon-deuteride excimer (ArD).

TABLE I

Pulse voltages required to operate 50 × 50 arrays of microcavity plasma devices having three electrodes at Ne 500 Torr. All values in the table show the minimum value necessary for operation under the given conditions.

| Electrode | $V_x$ | $V_y$ | $V_z$ (5 μs) |
|---|---|---|---|
| Voltage | 165 | 165 | 0 |
| (V) | 160 | 140 | 40 |
| | 160 | 135 | 50 |
| | 155 | 140 | 50 |
| | 155 | 140 | 55 |
| | 155 | 130 | 60 |
| | 155 | 125 | 70 |
| | 155 | 123 | 80 |

TABLE II

Pulse voltages required to operate the 50 × 50 array of Table I as the pulse width of the voltage $V_z$ is varied. $V_z$ is fixed to 50 V.

| Pulse Width of $V_z$ (μsec) | $V_x$ | $V_y$ | $V_z$ |
|---|---|---|---|
| 1 | | No change | |
| 2 | 165 | 145 | 50 |
| 3 | 160 | 140 | 50 |
| 5 | 155 | 140 | 50 |
| 7 | 150 | 140 | 50 |
| 10 | 150 | 140 | 50 |

FIG. 14 shows the trigger, x and y waveforms that were applied during testing. The waveforms in FIG. 14 show a cycle of bipolar pulses that are applied to the address electrode for every five cycles of $V_x$-$V_y$ pulse operation.

Figure 15:
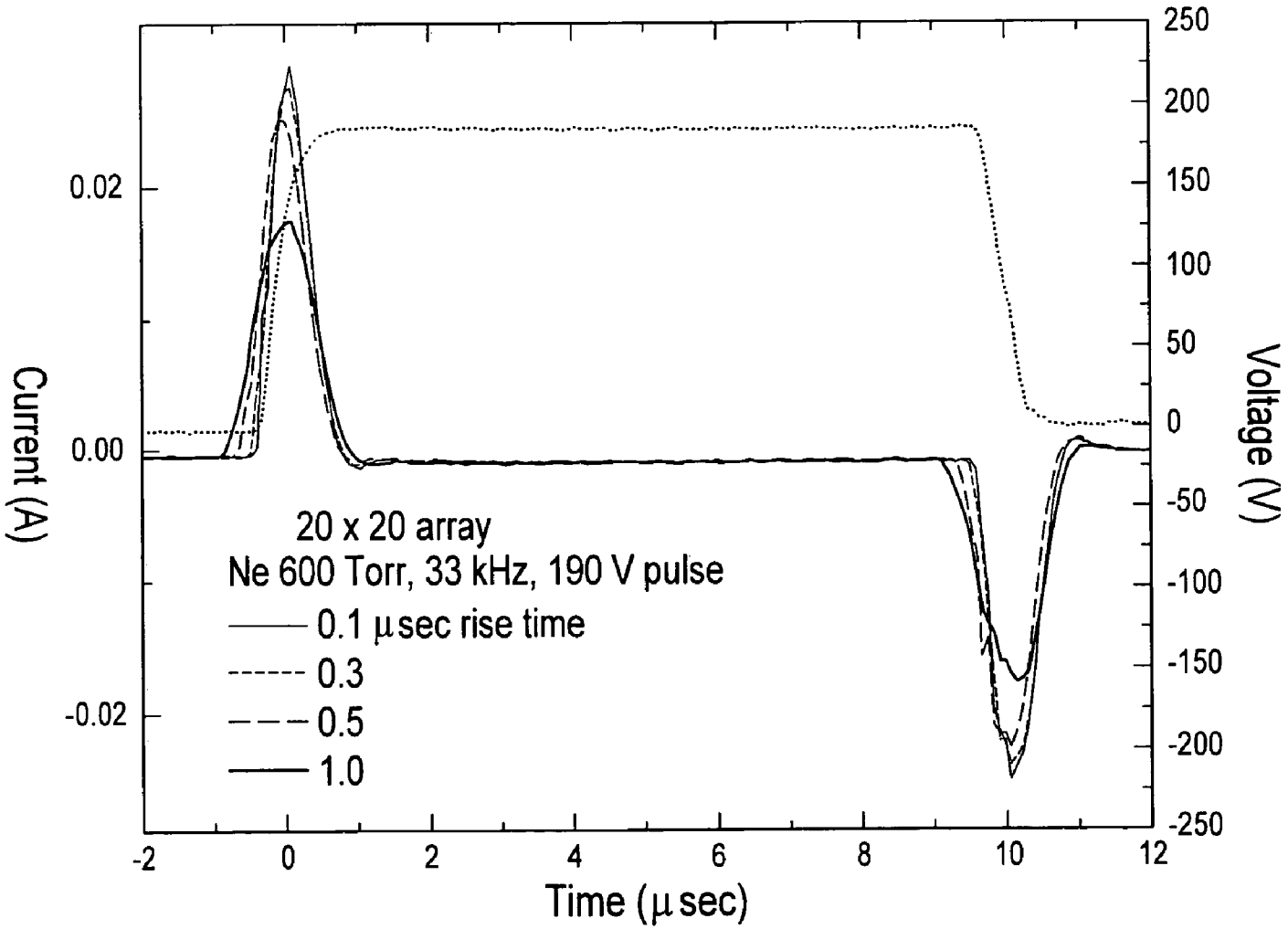
FIG. 15 shows a voltage waveform (dotted line) applied during testing of a prototype 20×20 array of devices of the invention, and the resulting current waveforms.

FIG. 15 illustrates additional waveforms that were applied during testing. Current waveforms were recorded for operation of 20×20 arrays of addressable devices at a sinusoidal driving frequency of 33 kHz and in 600 Torr of Ne. As evidenced by FIG. 15, the rise time of the current in an addressable array comprising 20×20 devices is more than adequate for display (in fact, virtually all) applications. Specifically, for a sinusoidal driving frequency of 33 kHz, the current risetime for the array is <200 ns. With more precise patterning of the electrodes as is available in typical commercial fabrication processes, this value should be readily reduced below 100 ns.

Figure 16:
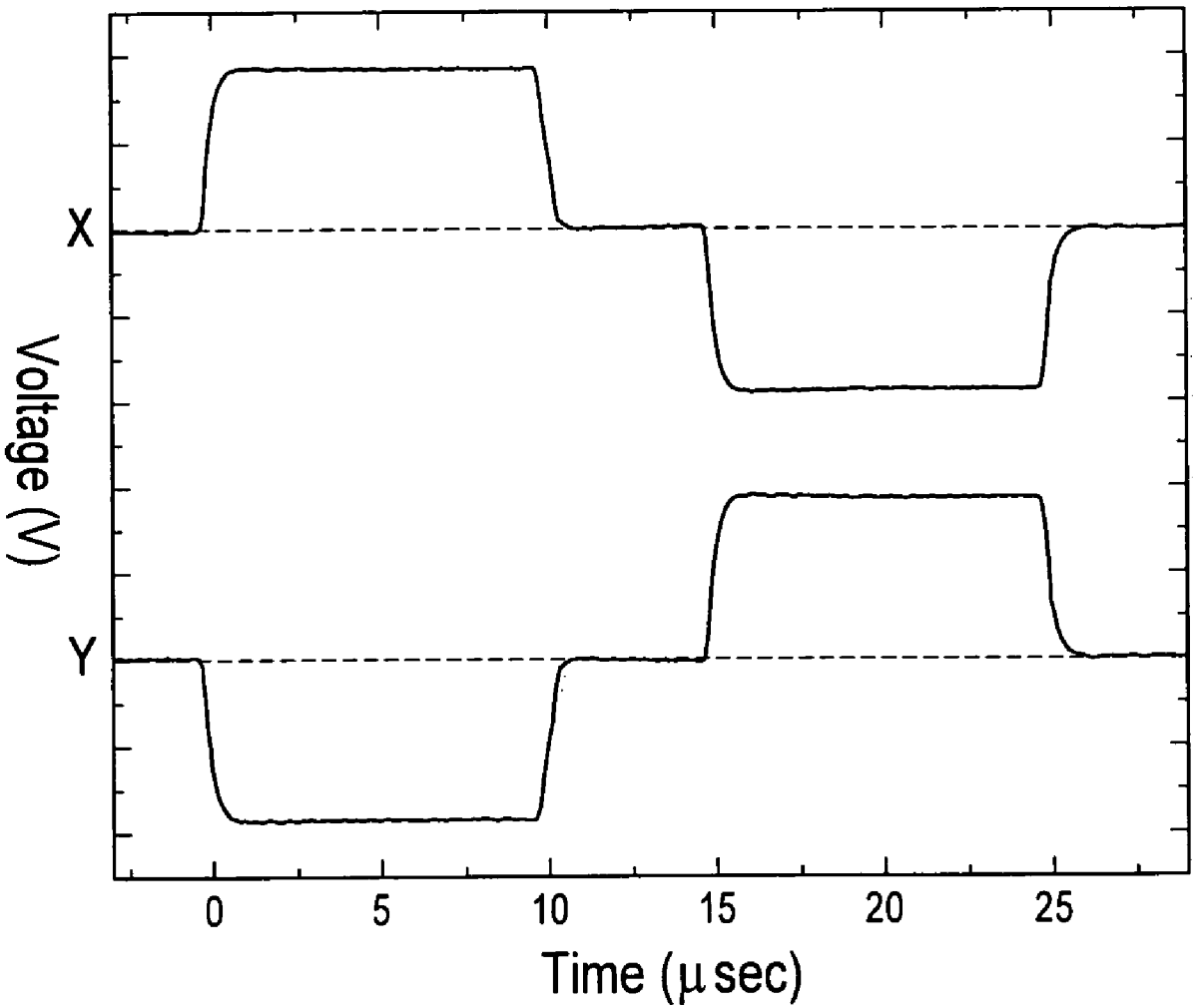
FIG. 16 shows a set of voltage waveforms applied during testing of the 20×20 prototype array.

Another alternative driving waveform is a bipolar pulsed DC waveform in which each addressable channel overlaps with the other with opposite polarity. This results in lowering the driving voltage by a factor of two. FIG. 16 shows an example of the pulsed voltage waveform in the sustain mode.

While specific embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

The invention claimed is:

1. A microcavity plasma device, the device comprising:

a substrate having a microcavity formed therein;

first and second electrodes disposed to excite a plasma in said microcavity upon application of application of a time-varying potential between the first and second electrodes;

dielectric isolating said first and second electrodes from a plasma formed in said microcavity; and a trigger electrode disposed proximate said microcavity.

2. The device of claim 1, further comprising a controller for applying a voltage waveform to said trigger electrode for reducing the required operating voltage applied to said first and second electrodes to excite a plasma in said microcavity.

3. The device of claim 1, wherein said trigger electrode is disposed opposite said microcavity.

4. The device of claim 3, wherein said trigger electrode comprises a transparent electrode.

5. The device of claim 4, wherein said trigger electrode is disposed upon a transparent layer opposite said microcavity.

6. The device of claim 3, wherein said trigger electrode is approximately 500 μm or less from said microcavity.

7. The device of claim 6, wherein said microcavity comprises a tapered microcavity.

8. The device of claim 7, wherein said microcavity comprises an inverted pyramidal microcavity.

9. The device of claim 1, wherein said trigger electrode is disposed adjacent the microcavity.

10. The device of claim 9, wherein said microcavity comprises a tapered microcavity.

11. The device of claim 10, wherein said microcavity comprises an inverted pyramidal microcavity.

12. The device of claim 1, wherein said microcavity comprises a tapered microcavity.

13. The device of claim 12, wherein said microcavity comprises an inverted pyramidal microcavity.

14. The device of claim 1, wherein said substrate comprises a conductive or semi-conductive substrate that acts as one of said first and second electrodes.

15. The device of claim 1, wherein said substrate comprises one of a semiconductor and an insulator, and said first and second electrodes comprise metal electrodes.

16. The device of claim 15, wherein one of said first and second electrodes is disposed in said microcavity.

17. An array of microcavity plasma devices, comprising a plurality of devices according to claim 15, wherein said first and second electrodes comprise electrodes respectively interconnecting rows and columns of microcavities of said plurality of devices and said trigger electrode comprises a plurality of trigger electrode proximate rows or columns of the microcavities.

18. The array of claim 17, further comprising a controller for applying voltage waveforms to said first and second and trigger electrodes.

19. The array of claim 18, wherein a voltage waveform applied to said trigger electrodes comprise a series of pulses corresponding to voltage pulses applied to said first and second electrodes.

20. The array of claim 19, wherein the series of pulses applied to said trigger electrodes has fewer cycles than that of voltage pulses applied to said first and second electrodes.

21. An array of microcavity plasma devices, comprising a plurality of devices according to claim 1, wherein said first, second and trigger electrodes comprise electrodes respectively interconnecting pluralities of microcavities of said plurality of devices.

22. The array of claim 21, wherein one of said first and second electrodes and said trigger electrodes are each patterned to border apertures of the pluralities of microcavities along two sides of the microcavities.

23. The array of claim 22, wherein one of said first and second electrodes is disposed in said microcavity.

24. The device of claim 1, further comprising phosphor disposed in said microcavity.

25. The device of claim 1, further comprising phosphor disposed opposite said microcavity.

26. The device of claim 1, wherein said dielectric comprises alternating layers of dielectric including a thick upper layer.

27. The device of claim 1, wherein said dielectric comprises alternating layers of nitride and polymer including a thick polymer upper layer.

28. The device of claim 1, wherein said microcavity comprises a double-sided, symmetrical microcavity.

29. An array of microcavity plasma devices, comprising a plurality of devices according to claim 1, wherein said first and second electrodes comprise electrodes respectively interconnecting rows and columns of microcavities of said plurality of devices and said trigger electrode comprises a plurality of trigger electrode proximate rows or columns of the microcavities.

30. The array of claim 29, further comprising a controller for applying voltage waveforms to said first and second and trigger electrodes.

31. The array of claim 30, wherein a voltage waveform applied to said trigger electrodes comprise a series of pulses corresponding to voltage pulses applied to said first and second electrodes.

32. The array of claim 29, wherein said microcavity comprises a tapered microcavity.

33. The array of claim 32, wherein said microcavity comprises an inverted pyramidal microcavity.

34. A microcavity plasma device, the device comprising:

a substrate having a double-sided symmetrically microcavity formed therein;

first and second electrodes disposed to excite a plasma in said microcavity upon application of application of a time-varying potential between the first and second electrodes; and dielectric isolating said first and second electrodes from a plasma formed in said microcavity.

35. The device of claim 34, further comprising a trigger electrode disposed proximate said microcavity.

36. A microcavity plasma device, the device comprising:

a substrate having a tapered microcavity formed therein;

first and second electrodes disposed to excite a plasma in said microcavity upon application of application of a time-varying potential between the first and second electrodes, one of said first and second electrodes being formed in said tapered microcavity;

dielectric isolating said first and second electrodes from a plasma formed in said microcavity;

a layer to seal said microcavity;

standoff portions holding said layer to seal a distance away from an upper dielectric layer of said dielectric; and a void disposed around said standoff portions.

37. The device of claim 36, wherein said standoff portions comprise trigger electrodes.

38. The device of claim 36, wherein said standoff portions comprise dielectric.

* * * * *